United States Patent [19]

Ueda et al.

[11] Patent Number: 4,717,648

[45] Date of Patent: Jan. 5, 1988

[54] PROCESS FOR PROCESSING A COLOR REVERSAL PHOTOGRAPHIC LIGHT-SENSITIVE MATERIAL

[75] Inventors: Shinji Ueda; Junya Nakajima; Tadao Shishido; Sadanobu Shuto, all of Kanagawa, Japan

[73] Assignee: Fuji Photo Film Co., Ltd., Kanagawa, Japan

[21] Appl. No.: 827,138

[22] Filed: Feb. 7, 1986

[30] Foreign Application Priority Data

Feb. 7, 1985 [JP] Japan ..... 60-22603
Feb. 14, 1985 [JP] Japan ..... 60-26708

[51] Int. Cl.[4] ..... G03C 7/16; G03C 5/50; G03C 5/24

[52] U.S. Cl. ..... 430/379; 430/407; 430/445; 430/446; 430/489; 430/487

[58] Field of Search ..... 430/379, 407, 445, 446, 430/489, 487

[56] References Cited

U.S. PATENT DOCUMENTS 2,956,876 10/1960 Spath ..... 430/379
4,371,610 2/1983 Toyoda et al. ..... 430/355
4,391,900 7/1983 Toyoda et al. ..... 430/445
4,554,245 11/1985 Hayashi et al. ..... 430/567

*Primary Examiner*—Richard L. Schilling
*Assistant Examiner*—Lee C. Wright
*Attorney, Agent, or Firm*—Sughrue, Mion, Zinn, Macpeak & Seas

[57] ABSTRACT

A process for processing a silver halide color reversal photographic light-sensitive material is disclosed, which comprises developing an imagewise exposed silver halide color reversal photographic light-sensitive material with a black-and-white developer containing at least one compound selected from the compounds of Group A, at least one compound selected from the compounds of Group B, and preferably further at least one compound selected from the compounds of Group C, wherein Group A consists of organic heterocyclic compounds represented by formulae (A-I), (A-II), (A-III), and (A-IV)

(A-I)

(A-II)

(A-III)

(A-IV)

Group B consists of benzoimidazole, indazole, benzotriazole, benzooxazole and benzothiazole compounds, not containing a thiol group, a thioether bond, a thioketone group, or a disulfide bond.

Group C consists of compounds represented by formulae (C-I) and (C-II).

(C-I)

(C-II)

wherein the symbols are as defined in the appended claims.

20 Claims, No Drawings

PROCESS FOR PROCESSING A COLOR REVERSAL PHOTOGRAPHIC LIGHT-SENSITIVE MATERIAL

FIELD OF THE INVENTION

The present invention relates to a process for processing a silver halide color reversal photographic light-sensitive material. More particularly, the present invention relates to a black-and-white developing method employed in a method for forming a color photographic image by applying color reversal development after black-and-white development, which permits to have a high sensitivity and a high maximum density, and obtain a photographic image well balanced in colors. Furthermore, the present invention relates to a sensitizing method which enables to obtain varied sensitivities by changing processing conditions, or a rapid processing method which enables to form an image quickly.

BACKGROUND OF THE INVENTION

For a silver halide color reversal light-sensitive material, it is required to apply a very limited and suitable amount of exposure in order to form a useful image, therein because its permissible range of exposure is narrow. This is because the color reversal light-sensitive material is designed so that the gradation is high is compared with a color negative light-sensitive material, since the image formed is used, for example, as a positive image for viewing. Thus it is necessary to use a light-sensitive material having the optimum sensitivity depending on the particular purpose of use and exposing conditions.

Photographing special scenes, such as sports photographs, which require a high shutter speed, and stage photographs, which are obtained under conditions such that the amount of light necessary for exposure is deficient, requires a high sensitivity color light-sensitive material. Only a very limited number of color reversal photographic light-sensitive materials can satisfy the above requirements.

Under such circumstances, it has been desired to develop a high sensitivity color reversal light-sensitive material and a method of controlling sensitivity to compensate for the deficiency of exposure.

In order to meet the above requirements, a number of development accelerating methods and push development methods have been proposed.

A method which has been most popularly employed for a long period of time is to lengthen the time of black-and-white development, or to increase the developing temperature.

This push development method, however, does not always provide a color reversal light-sensitive material with a sufficient sensitization suitability, and causes the following problems:

(1) Sensitization cannot be accomplished unless the time for the first development is greatly increased as compared with the standard processing;

(2) In a light-sensitive material having a structure that comprises a high sensitivity layer and a low sensitivity layer, the sensitizing processing causes changes in gradation because the two layers are different in development processing suitablility;

(3) If the developed film speed is intended to increase by lengthening the time for the first development, a serious decrease in the density of color image occurs; and (4) The sensitizing treatment causes degradation in the color balance because red-sensitive, green-sensitive, and blue-sensitive layers are different in development processing suitability.

It is known that a development accelerator is used for the purpose of increasing sensitivity. These accelerators are cationic surface active agent, cationic dyes, neutral salts, polyalkylene oxide, organic amines and the like as described in L. F. A. Mason, *Photographic Processing Chemistry*, pp. 41–44 Focal Press, London and New York (1966). These compounds, however, when added to a black-and-white developer, are not sufficiently high in development accelerating capability, and tend to increase the formation of fog and to decrease the maximum density of a reversal color image. Thus they are difficult to use in a commercial embodiment.

In order to the above problems, a processing method using a black-and-white developer containing a thioether compound is disclosed in Japanese Patent Application (OPI) No. 63530/82 (the term "OPI" as used herein means a "published unexamined Japanese patent application"). This method, however, has a disadvantage in that when the developed film speed is changed by changing the developing time or temperature, each rate of development of the blue-sensitive, green-sensitive and red-sensitive layers is different, and thus the color balance is degraded.

Furthermore, as a method of improving the above disadvantage a processing method using a two bath black-and-white developer is described in Japanese Patent Application (OPI) No. 81644/84. Although this method provides good performance, since the black-and-white development comprises two steps, administration of a processing liquid and processing conditions is complicated and very delicate, and it is difficult to maintain a constant photographic performance.

As an effective method to overcome the above defects in push development, a method for controlling development fog in the black-and-white development is described in L. F. A. Mason, Photographic Processing Chemistry pages 38 and 252 (1966). For example, halogen compounds such as bromides and iodides are well known and widely used in a black-and-white developer. In the case of push development, however, the fog-inhibiting power is not sufficient and the object cannot be attained.

1-Phenyl-5-mercaptotetrazole, 4-phenyl-2-mercaptothiazole, 2-mercaptobenzoxazole, 2-mercaptobenzothiazole and 1,2-naphthyl-5-mercaptotetrazole as described in U.S. Pat. No. 2,725,290 possess an effect of inhibiting excessive development of the upper layer of a multi-layer material when the black-and-white development is carried out at high temperatures. These compounds, however, inhibit the development of the upper layer even if used in a small amount because their development-inhibiting effect is very large. Thus if the above compounds are used in an increased amount to prevent the development or fog of the lower layer, they excessively inhibit the development of the upper layer, thereby reducing the color balance.

As compounds having an action which is lower than those of the above development inhibitors or antifoggants, the above-cited reference, L. F. A. Mason, *Photographic Processing Chemistry, pp.* 39–41, (1966) describes 5-methylbenzotriazole and 6-nitrobenzimidazole. These compounds, however, have disadvantages in that the effect of inhibiting the fog of the lower layer at the black-and-white development is small, and if the amount of the compounds added is increased, sensitivity is decreased because of their strong action inhibiting development of the lower layer.

In the sensitization developing processing or rapid developing processing of a multi-layer color reversal photographic light-sensitive material, it is necessary to balance the fog-preventing effect of each layer at the time of the black-and-white development. It is very difficult to inhibit the formation of fog at the time of black-and-white development while decreasing or eliminating influences on the development of the uppermost layer without decreasing the sensitivity of the lowermost layer.

SUMMARY OF THE INVENTION

It has been desired to overcome the above problems and to develop a technique which provides the ability to control at will the developed film speed and further does not exert any adverse influences when subjected to standard processing.

An object of the present invention is to provide a method for developing a color reversal light-sensitive material, which enables to obtain a photographic image in which the sensitivity and maximum density are high, particularly the sensitivity and maximum density of the red-sensitive layer are high, and the color balance is good.

Another object of the present invention is to provide a method for developing a color reversal light-sensitive material, which enables to obtain a photographic image of varied sensitivities by changing its conditions.

Further object of the present invention is to provide a rapid developing method of a color reversal light-sensitive material which provides formation of a good photographic image in a short time.

It has been found that the above objects can be attained by a process using a black-and-white developer containing at least one compound selected from Group A, at least one compound selected from Group B, and preferably further at least one compound selected from Group C, said Groups A, B, and C being described hereinafter.

That is, the present invention is directed to a process for processing a silver halide color reversal photographic light-sensitive material which comprises treating an imagewise exposed silver halide color reversal photographic light-sensitive material with a black-and-white developer containing at least one compound selected from the compounds of Group A and at least one compound selected from the compounds of Group B, wherein Group A consists of organic heterocyclic compounds represented by formulae (A-I), (A-II), (A-III), and (A-IV):

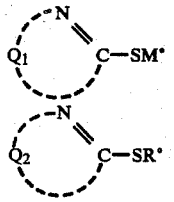

(A-I)

(A-II)

-continued

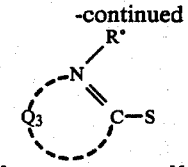

(A-III)

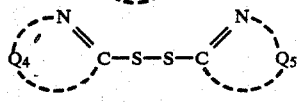

(A-IV)

wherein $Q_1$, $Q_2$, $Q_3$, $Q_4$, and $Q_5$ each represents an atomic group forming a 5- or 6-membered substituted or unsubstituted heterocyclic group, or an atomic group forming a 5- or 6-membered heterocyclic group condensed with a benzene ring, R° represents a substituted or unsubstituted alkyl group, a substituted or unsubstituted aryl group, or a substituted or unsubstituted aralkyl group, and M° represents a hydrogen atom, an alkali metal atom or an ammonium ion; and Group B consists of benzoimidazole compounds, indazole compounds, benzotriazole compounds, benzooxazole compounds, and benzothiazole compounds, provided that they do not contain a thiol group, a thioether bond, a thioketone group, or a disulfide bond.

According to a preferred embodiment of the present invention, the black-and-white developer contains at least one of the compounds of Group A aside from the compounds of formulae (C-I) and (C-II) as defined below, at least one compound selected from the compounds of Group B, and further at least one compound represented by formulae (C-I) and (C-II)

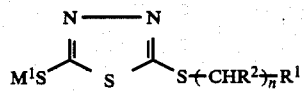

(C-I)

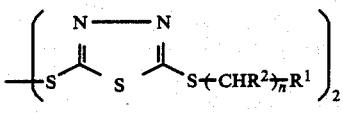

(C-II)

wherein $M^1$ represents a hydrogen atom, an alkali metal atom or an ammonium ion, $R_1$ represents $-(\text{alkylene})_n-SO_3M^2$ or $-(\text{alkylene})_m-COOM^2$, $R^2$ represents a hydrogen atom, a substituted or unsubstituted alkyl group (the total number of carbon atoms of the alkyl group is 1 to 4), $-SO_3M^2$ or $-COOM^2$; $M^2$ represents a hydrogen atom, an alkali metal atom or an ammonium ion; alkylene may be a substituted or unsubstituted straight-chain, or a substituted or unsubstituted branch-chain, and the total number of carbon atoms of the alkylene is preferably 1 to 4; m is 0 or 1 and n is an integer of from 1 to 6, provided that when n is 2 or more, the $R^2$ groups can be the same or different.

DETAILED DESCRIPTION OF THE INVENTION

The present invention relates to a process for processing an imagewise exposed silver halide color reversal photographic light-sensitive material using a black-and-white developer containing at least one compound selected from Group A, at least one compound selected from Group B, and preferably further at least one compound selected from Group C.

Group A consists of organic heterocyclic compounds represented by formulae (A-I) to (A-IV)

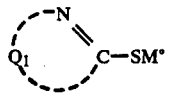

(A-I)

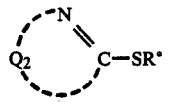

(A-II)

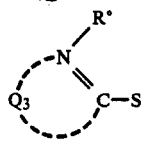

(A-III)

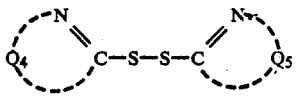

(A-IV)

wherein $Q_1$, $Q_2$, $Q_3$, $Q_4$, and $Q_5$ each represents an atomic group forming a 5- or 6-membered substituted or unsubstituted heterocyclic group, or an atomic group forming a 5- or 6-membered heterocyclic group condensed with a benzene ring; R° represents a substituted or unsubstituted alkyl group, a substituted or unsubstituted aryl group, or a substituted or unsubstituted aralkyl group; and M° is a hydrogen atom, an alkali metal atom or an ammonium ion.

Group B consists of benzoimidazole, indazole, benzotriazole, benzooxazole, and benzothiazole compounds, provided that they do not contain a thiol group, a thioether bond, a thioketone group, or a disulfide bond.

It has been astonishingly found that if a color reversal light-sensitive material is processed with a black-and-white developer containing the compounds of Groups A and B in combination, both the compounds harmonize, and thereby a good color image is obtained, and particularly colors of the top and bottom layers (i.e., a yellow-coloring layer, a magenta-coloring layer and a cyan-coloring layer) are well balanced.

Further, in order to raise the maximum density of the uppermost layer (i.e., the high density region), and obtain the color image having a good color balance, the present inventors have found that when processing a color reversal photographic light-sensitive material using a black-and-white developer containing compounds selected from groups A (aside from C), B, and C, the compounds each harmonizers, thereby producing a color image in which the maximum density and the color balance are both satisfactory.

Group C consists of compounds represented by formula (C-I) and (C-II)

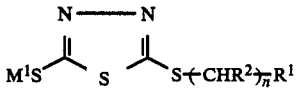

(C-I)

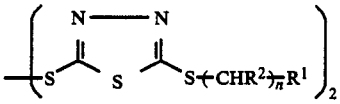

(C-II)

wherein $M^1$ represents a hydrogen atom, an alkali metal atom, or an ammonium ion; $R^1$ represents $\text{-(alkylene)}_m\text{-}SO_3M^2$ or $\text{-(alkylene)}_m\text{-}COOM^2$; $R^2$ represents a hydrogen atom, a substituted or unsubstituted alkyl group (the total number of carbon atoms of the alkyl group is 1 to 4), $-SO_3M^2$, or $-COOM^2$; $M^2$ represents a hydrogen atom, an alkali metal atom, or an ammonium ion; alkylene may be a substituted or unsubstituted straight-chain, or a substituted or unsubstituted branch-chain (the total number of carbon atoms of the alkylene is preferably 1 to 4); m is 0 or 1; and n is an integer of from 1 to 6, provided that when n is 2 or more, the $R^2$ groups can be the same or different.

Of the above compounds, some compounds are known. For example, U.S. Pat. No. 2,725,290 describes that in a color developer, a mercaptoazole compound and a benzotriazole compound may be used in combination. However it is not suggested what kind of effect can be obtained when they are used in combination. Moreover there cannot be found any disclosure or suggestion concerning the addition of the compounds of the present invention to a black-and-white developer for reversal color processing, having a composition completely different from that of the color developer.

Japanese Patent Application (OPI) No. 102639/76 discloses the addition of a 5-mercapto-1,3,4-thiadiazole compound to a color developer or its prebath. However there is neither description nor suggestion concerning the addition of two or more kinds of compounds according to the present invention.

Under the above circumstances, it has been found that two or three kinds of compounds according to the present invention possess a novel action or effect in a method completely different from the conventional methods.

Formula (A) is described below in more detail. In formula (A), $Q_1$ to $Q_5$ (which may be the same or different) each represents an atomic group forming a 5- or 6-membered heterocyclic group which may be substituted, or an atomic group forming a 5- or 6-membered heterocyclic group condensed with a benzene ring.

Examples of the heterocyclic group include a pyrrole ring, a pyrazole ring, an imidazole ring, an imidazoline ring, a benzimidazole ring, a benzimidazoline ring, a triazole ring, a tetrazole ring, a thiazole ring, a thiazoline ring, a benzothiazole ring, a naphthothiazole ring, a benzothiazoline ring, an oxazole ring, an oxazoline ring, a benzoxazole ring, a benzoxazoline ring, a pyridine ring, a pyrimidine ring, a triazine ring, a pyrazine ring, a thiazine ring, an oxazine ring, a thiadiazole ring, an oxadiazole ring, and a tetraazaindene ring. Examples of substituents for the above heterocyclic rings include a substituted or unsubstituted alkyl group (e.g., a methyl group, an ethyl group, an octyl group, a hydroxyethyl group, a methoxyethyl group, a dimethylaminoethyl group, an ethoxycarbonylethyl group, an acyloxyethyl group, a methylthioethyl group, and a morpholinomethyl group), an allyl group, a substituted or unsubstituted aryl group (e.g., a phenyl group, a naphthyl group, a caproamidophenyl group, a nitrophenyl group, a chlorophenyl group, a methylphenyl group, an ethoxyphenyl group, a methanesulfonylphenyl group, a carboxyphenyl group, a sulfoxyphenyl group, a carbamoylphenyl group, and a dimethylaminophenyl group), a substituted or unsubstituted aralkyl group (e.g., a benzyl group, a chlorobenzyl group, and a methoxybenzyl group), a halogen atom (e.g., chlorine, bromine, and iodine), a nitro group, a substituted or unsubstituted alkoxy group (e.g., a methoxy group, an ethoxy group, and a methoxyethoxy group), a substituted or unsubstituted aryloxy group (e.g., a phenoxy group, a methylphenoxy group, and a chlorophenoxy group), a substituted or unsubstituted alkylthio group (e.g., a methylthio group, a methoxyethylthio group, and hydroxyethylthio group), a substituted or unsubstituted arylthio group (e.g., a phenylthio group, a carboxyphenylthio group, and a naphthylthio group), —COOM$^3$, —COOR$^3$, —SO$_3$M$^3$, —SO$_3$R$^3$, —SO—R$^3$, —SO$_2$R$^3$, —NH$_2$, —NHR$^3$,

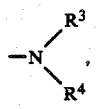

—NHCOR$^3$, —NH.CO.NH.R$^3$, —NHCO$_2$R$^3$, —CONH—R$^3$, —CONH$_2$, —SO$_2$NH$_2$, —SO$_2$NHR$^3$ (wherein M$^3$ represents a hydrogen atom, NH$_4$, or an alkali metal such as a sodium atom and a potassium atom, and R$^3$ and R$^4$ each represents a substituted or unsubstituted alkyl group, an aryl group, an aralkyl group, or a heterocyclic group (e.g., a pyridine ring, a thiadiazole ring, and an imidazole ring)), and so forth. The total number of carbon atoms of these substituents is preferably 8 or less.

R° in formula (A) represents a substituted or unsubstituted alkyl group (e.g., a methyl group, an ethyl group, an octyl group, a hydroxyethyl group, a methoxyethyl group, a dimethylaminoethyl group, an ethoxycarbonylethyl group, an acyloxyethyl group, a methylthioethyl group, a morpholinomethyl group, and those compounds having a total number of carbon atoms of 7 or less are preferred), a substituted or unsubstituted aryl group (e.g., a phenyl group, a naphthyl group, a caproamidophenyl group, a nitrophenyl group, an iminophenyl group, a chlorophenyl group, a methylphenyl group, an ethoxyphenyl group, a methanesulfonylphenyl group, a carboxyphenyl group, a sulfoxyphenyl group, a carbamoylphenyl group, a dimethylaminophenyl group, and those compounds having a total number of carbon atoms of 10 or less are preferred), or a substituted or unsubstituted aralkyl group (e.g., a benzyl group, a chlorobenzyl group, a methoxybenzyl group, and those compounds having a total number of carbon atoms of 10 or less are preferred).

M° in formula (A) represents a hydrogen atom, an alkali metal atom (e.g., a soldium atom and a potassium atom), or an ammonium ion.

Preferred examples of the compounds of Group A are shown below, although the present invenion is not limited thereto.

A-1

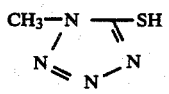

A-2

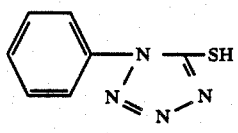

A-3

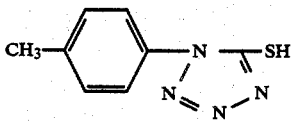

-continued

A-4

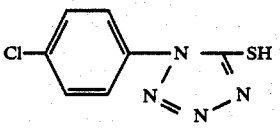

A-5

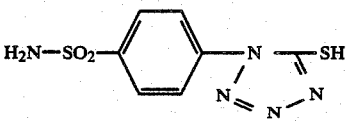

A-6

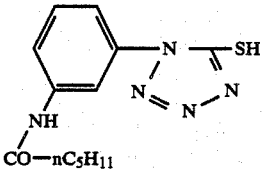

A-7

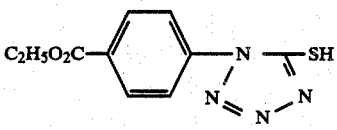

A-8

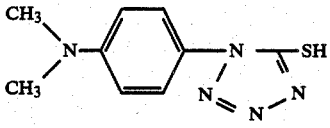

A-9

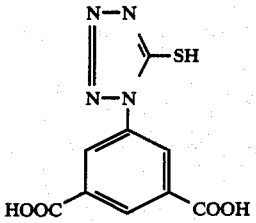

A-10

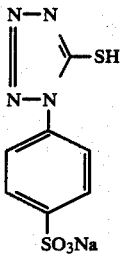

A-11

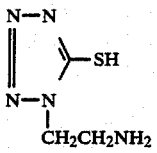

A-12

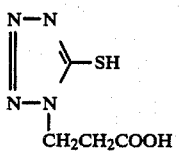

-continued
A-13
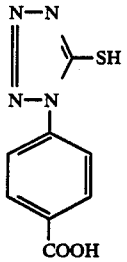
A-14
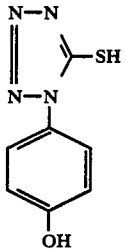
A-15
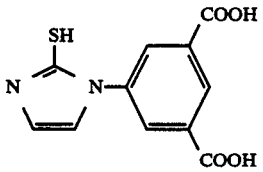
A-16
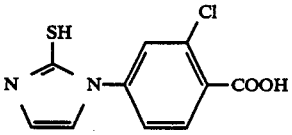
A-17
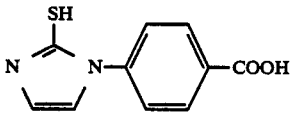
A-18
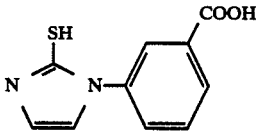
A-19
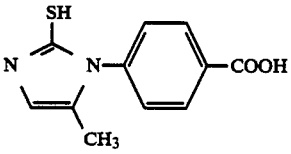
A-20
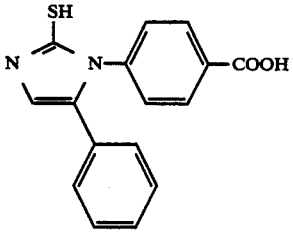
-continued
A-21
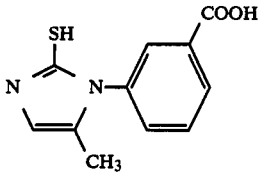
A-22
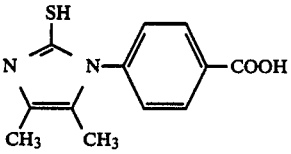
A-23
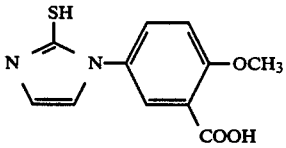
A-24
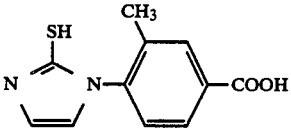
A-25
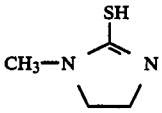
A-26
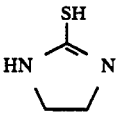
A-27
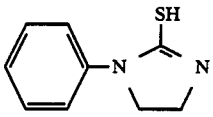
A-28
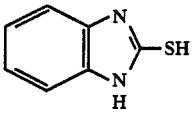
A-29
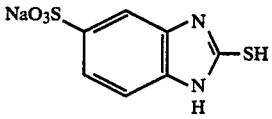
A-30
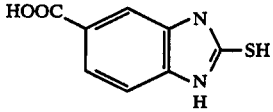
A-31
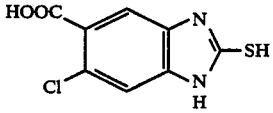

-continued
A-32
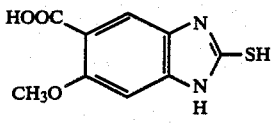
A-33
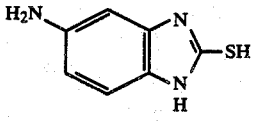
A-34
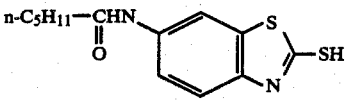
A-35
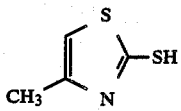
A-36
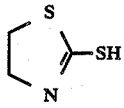
A-37
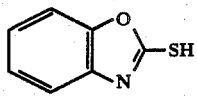
A-38
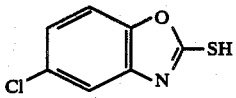
A-39
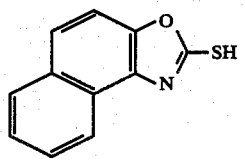
A-40
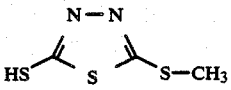
A-41
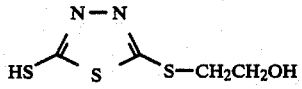
A-42
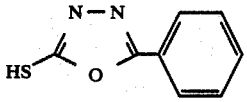
A-43
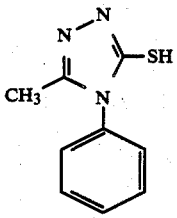
-continued
A-44
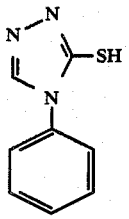
A-45
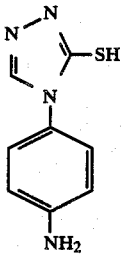
A-46
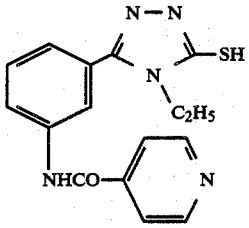
A-47
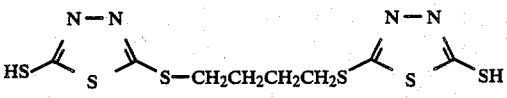
A-48
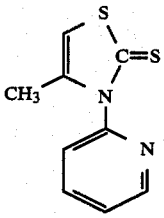
A-49
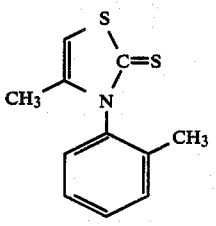
A-50
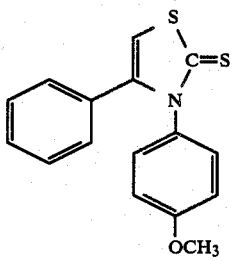

-continued
A-51
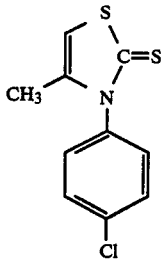
A-52
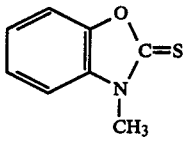
A-53
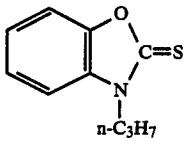
A-54
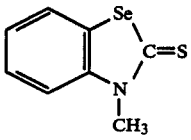
A-55
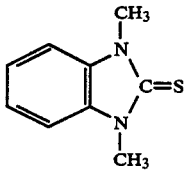
A-56
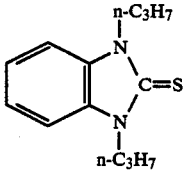
A-57
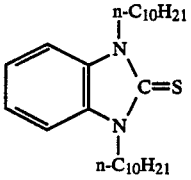
A-58
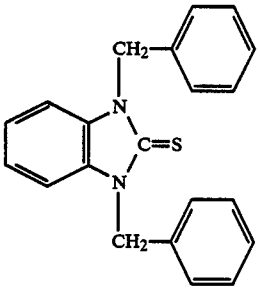
-continued
A-59
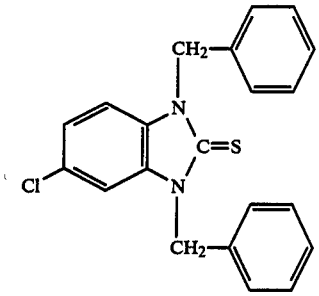
A-60
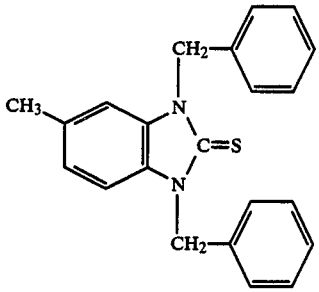
A-61
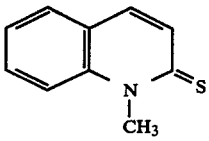
A-62
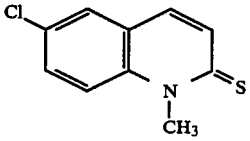
A-63
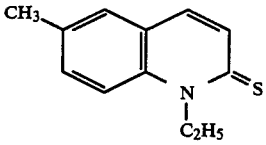
A-64
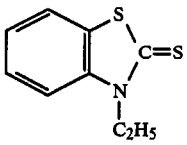
A-65
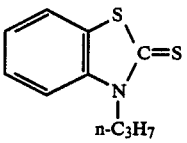
A-66
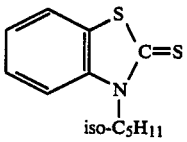

-continued
A-67
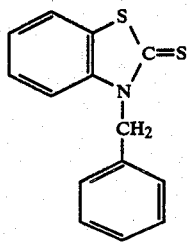
A-68
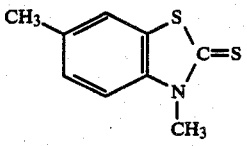
A-69
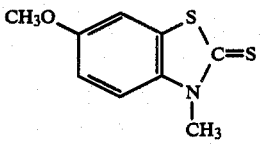
A-70
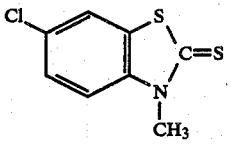
A-71
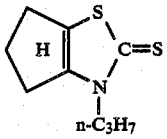
A-72
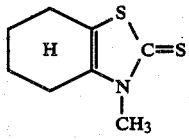
A-73
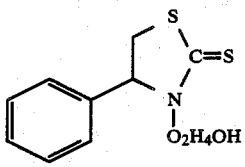
A-74
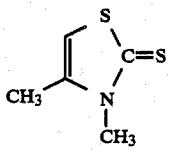
A-75
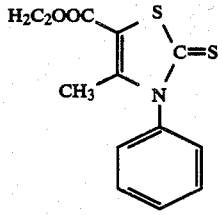
-continued
A-76
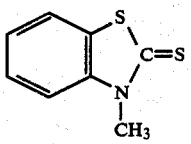
A-77
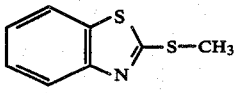
A-78
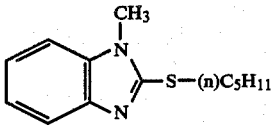
A-79
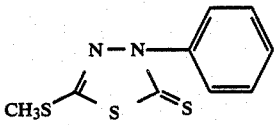
A-80
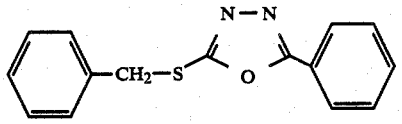
A-81
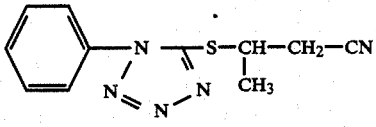
A-82
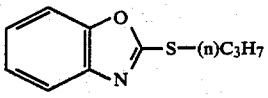
A-83
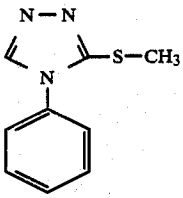
A-84
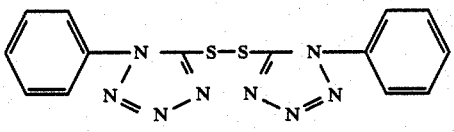
A-85
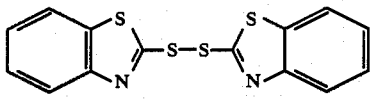
A-86
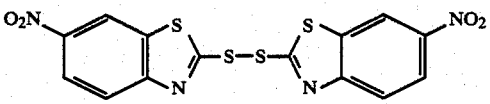
A-87
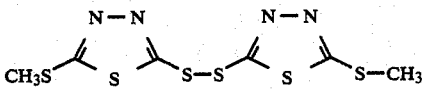

-continued

A-88

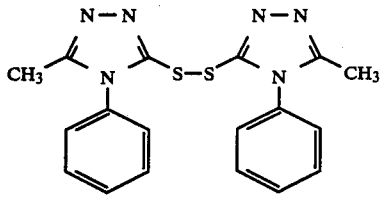

A-89

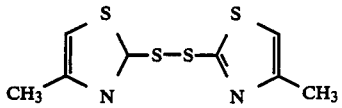

A-90

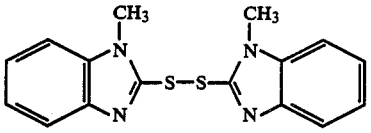

A-91

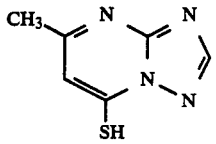

A-92

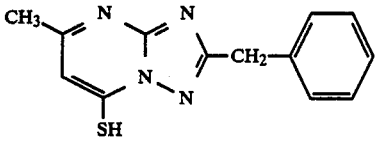

A-93

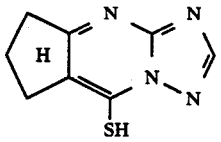

A-94

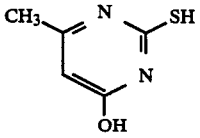

A-95

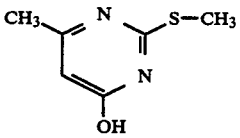

A-96

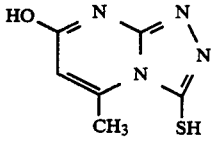

The compounds of Group B are described below in more detail.

The benzimidazole, indazole, benzoxazole, benzotriazole and benzothiazole compounds may be substituted. Examples of the substituent are a substituted or unsubstituted alkyl group (e.g., a methyl group, an ethyl group, an octyl group, a hydroxyethyl group, a methoxyethyl group, a dimethylaminoethyl group, an ethoxycarbonylethyl group, and a morpholinomethyl group), an allyl group, a substituted or unsubstituted aryl group (e.g., a phenyl group, a naphthyl group, a caproamidophenyl group, a nitrophenyl group, a chlorophenyl group, a methylphenyl group, a methanesulfonylphenyl group, a carboxyphenyl group, a sulfoxyphenyl group, a carbamoylphenyl group, and a dimethylaminophenyl group), a substituted or unsubstituted aralkyl group (e.g., a benzyl group, a chlorobenzyl group, and a methoxybenzyl group), a halogen atom (e.g., a chlorine atom, a bromine atom, and an iodine atom), a nitro group, a substituted or unsubstituted alkoxyl group (e.g., a methoxy group, an ethoxy group, and a methoxyethoxy group), a substituted or unsubstituted aryloxy group (e.g., a phenoxy group, a methylphenoxy group, and a chlorophenoxy group), $-COOM^4$, $-COOR^5$, $-SO_3M^4$, $-SO_3R^5$, $-SO-R^5$, $-SO_2R^5$, $-NH_2$, $-NHR^5$,

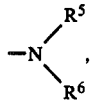

$-NHCOR^5$, $-NHCONHR^5$, $-NHCO_2R^5$, $-CONHR^5$, $-CONH_2$, $-SO_2NH_2$, and $-SO_2NHR^5$ (wherein $M^4$, and $R^5$ and $R^6$ are the same as M° or R° respectively, defined for the formulae of the compounds of Group A). The total number of carbon atoms of these substituents is preferably 8 or less.

Preferred examples are shown below although the present invention is not limited thereto.

B-1

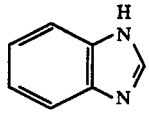

B-2

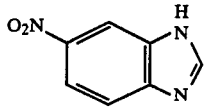

B-3

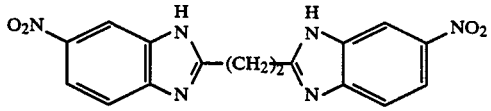

B-4

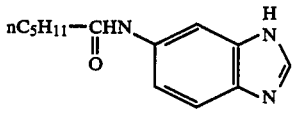

B-5

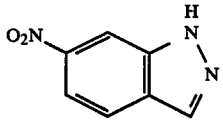

B-6

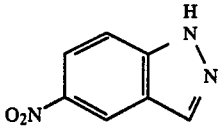

-continued
B-7
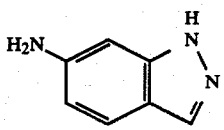
B-8
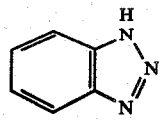
B-9
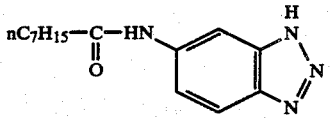
B-10
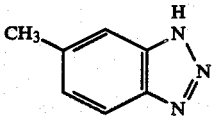
B-11
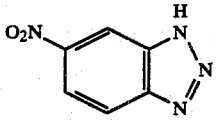
B-12
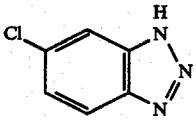
B-13
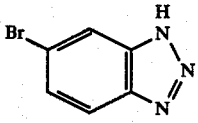
B-14
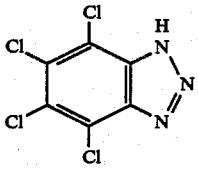
B-15
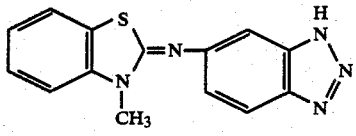
B-16
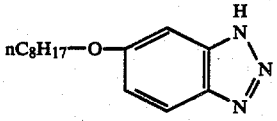
B-17
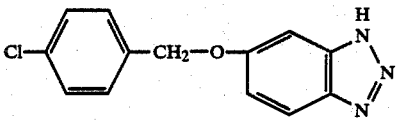
-continued
B-18
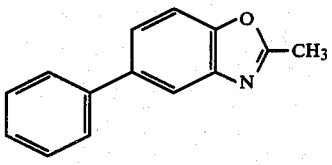
B-19
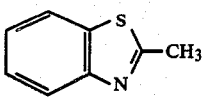
B-20
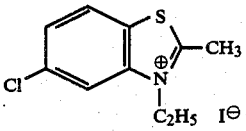
B-21
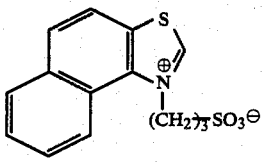
B-22
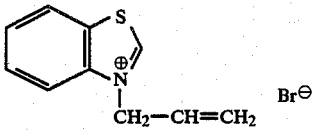
B-23
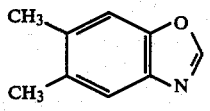
B-24
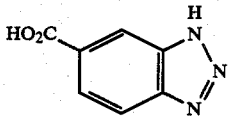
B-25
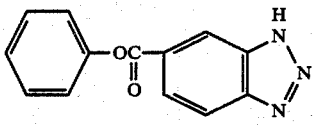
B-26
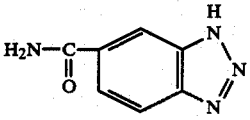
B-27
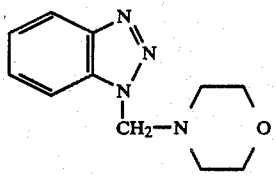
B-28
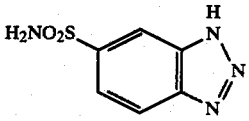

-continued
B-29
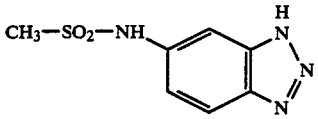
Preferred examples of the compounds of Group C are shown below, although the present invention is not limited thereto.
C-1
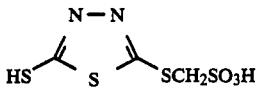
C-2
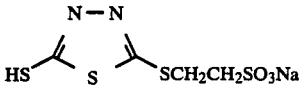
C-3
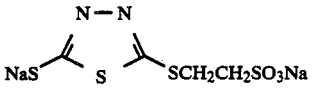
C-4
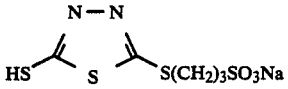
C-5
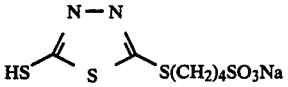
C-6
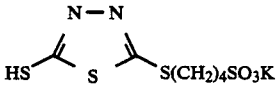
C-7
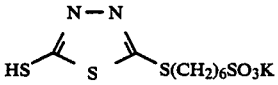
C-8
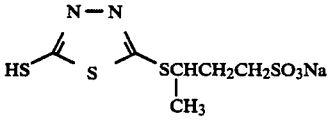
C-9
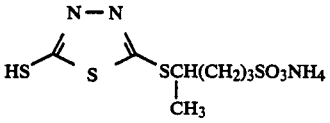
C-10
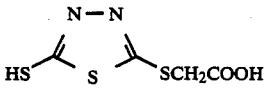
C-11
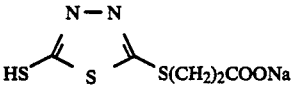
C-12
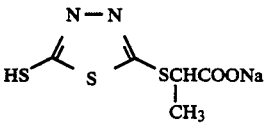
-continued
C-13
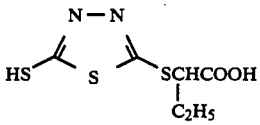
C-14
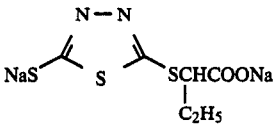
C-15
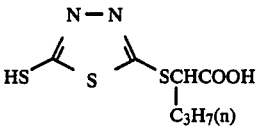
C-16
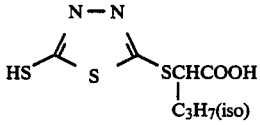
C-17
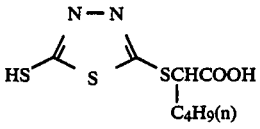
C-18
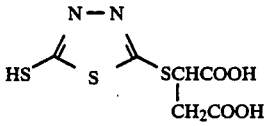
C-19
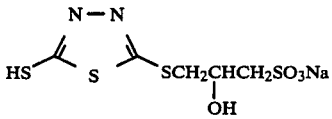
C-20
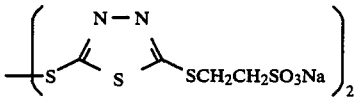
C-21
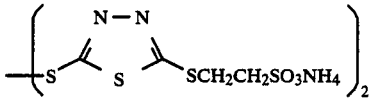
C-22
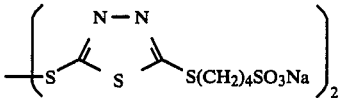
C-23
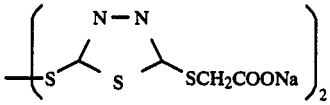
C-24
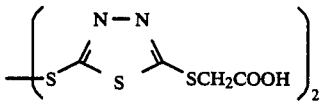

-continued

C-25

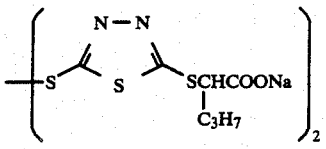

C-26

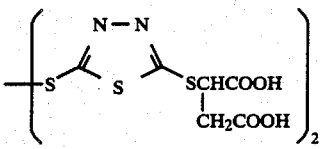

The amount of the compound of Group A added to 1 liter of a black-and-white developer for the reversal color processing is preferably from $0.5\times10^{-6}$ to $0.5\times10^{-2}$ mol, and particularly preferably from $1.0\times10^{-6}$ to $0.5\times10^{-3}$ mol. The amount of the compound of Group B added to 1 liter of a black-and-white developer for the reversal color processing is preferably from $0.5\times10^{-5}$ to $1.0\times10^{-1}$ mol, and particularly preferably from $1.0\times10^{-5}$ to $1.0\times10^{-2}$ mol.

The molar ratio of the compound of Group B to the compound of Group A is preferably from 2/1 to 500/1, and particularly preferably from 2/1 to 100/1.

The amount of the compound of Group C added to 1 liter of a black-and-white developer for the reversal color processing is preferably from $0.5\times10^{-6}$ to $5\times10^{-2}$ mol, and particularly preferably from $1.0\times10^{-6}$ to $1.0\times10^{-4}$ mol.

The molar ratio of the compound Group B to the compound of Group C to the compound of Group A is preferably 2-500/0.1-50/1, and particularly preferably 2-100/0.1-20/1. The ratios of the compounds of Group B and C are preferably chosen within the above ranges.

The silver halide color photographic light-sensitive material that is used in the present invention is a silver halide reversal color photographic light-sensitive material such as a reversal color film or a reversal color paper.

Photographic processing of the light-sensitive material of the present invention can be carried out by any known color image-forming methods as described in, for example, *Research Disclosure,* Vol. 176, pp. 28–30 RD-17643 (December 1978). The processing temperature is usually chosen between 18° and 60° C. The processing time is about from 1 to 15 minutes in the case of black-and-white development, and about from 1 to 10 minutes in the case of color development.

In a preferred embodiment of the present invention, the color reversal light-sensitive material is usually processed by the following steps:

Black-and-white development (first development);
Rinsing with water;
Reversal;
Color development;
Adjusting bath;
Bleaching;
Fixing;
Rinsing with water;
Stabilization; and
Drying.

In addition, a prebath, a pre-hardening bath, a neutralizing bath, a stopping bath, a water-rinsing bath, and so forth may be further provided. The reversal may be carried out in a fogging bath or by re-exposure. This can be omitted by adding a fogging agent to a color developing bath. The adjusting bath or stabilizing bath can be omitted. A bleach-fixer to perform bleaching and fixing at the same time can be used.

After the fixing or bleach-fixing step, steps such as rinsing with water and stabilization are usually applied. In addition, simplified methods such as, a method in which a water-rinsing step only is conducted, or a method in which such a rinsing step is not applied but only a stabilization step, is applied can be employed.

In the black-and-white developer that is used in the present invention, known developing agents can be used. As the developing agent, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolidones, ascorbic acid, and heterocyclic compounds resulting from condensation of a 1,2,3,4-tetrahydroquinone ring and an indolene ring as described in U.S. Pat. No. 4,067,872 can be used alone or in combination with each other. The amount of the black-and-white developer used is preferably from $1\times10^{-3}$ to $5\times10^{-1}$ mol/l.

To the black-and-white developer as used herein, if desired, a preservative (e.g., sulfites and hydrogensulfites), a buffer (e.g., carbonates, boric acid, borates, and alkanolamines), an alkali agent (e.g., hydroxides and carbonates), a dissolving aid (e.g., polyethylene glycols and their esters), a pH adjusting agent (e.g., organic acids such as acetic acid), a sensitizing agent (e.g., quaternary ammonium salts), a development accelerator, a surface active agent, a defoaming agent, a hardening agent, a tackifier, and so forth can be added.

It is necessary for the black-and-white developer as used herein to contain a compound which acts as a silver halide solvent. Usually, the sulfites added as the preservative serve as the silver halide solvents. Examples of the sulfites and other silver halide solvents are KSCN, NaSCN, $K_2SO_3$, $Na_2SO_3$, $K_2S_2O_5$, $Na_2S_2O_5$, $K_2S_2O_3$, and $Na_2S_2O_3$.

A development accelerator is used to impart a development accelerating action. In particular, the compounds of formula (D) described in Japanese Patent Application (OPI) No. 63530/82 can be used alone or in combination with each other, or further in combination with the above silver halide solvents.

$$R_{12}\text{-}(\text{S}-R_{11})_d\text{S}-R_{12} \qquad \text{(D)}$$

In formula (D), $R_{11}$ is an alkylene group having from 2 to 10 carbon atoms, which may contain an ether bond, $R_{12}$ is an alkyl group having from 2 to 10 carbon atoms, which may be substituted or may contain an ether bond or an ester bond, and d is an integer of from 0 to 3.

If the amount of the silver halide solvent used is too small, the development is retarded. On the other hand, if the amount of the silver halide solvent used is too large, the silver halide emulsion is fogged. The optimum amount of the silver halide solvent can be easily determined by one skilled in the art.

$SCN^{\ominus}$, for example, is used in an amount of from 0.005 to 0.02 mol, particularly preferably from 0.01 to 0.015 mol per liter of the developer. $SO_3^{2-}$ is used in an amount of from 0.05 to 1 mol and particularly preferably from 0.1 to 0.5 mol per liter of the developer.

The compound of formula (D) which is added to the black-and-white developer of the present invention, is used in an amount of preferably from $5\times10^{-6}$ to $5\times10^{-1}$ mol, more preferably from $1\times10^{-4}$ to $2\times10^{-1}$ per liter of the developer.

Further in combination with the compounds of the present invention, known antifoggants such as halides (e.g., potassium bromide and potassium iodide), can be added. These halides is used in an amount of preferably from $1\times10^{-6}$ to $5\times10^{-1}$ mol/l.

In addition, to the black-and-white developer of the present invention, a swell-inhibiting agent (e.g., inorganic salts such as sodium sulfate), a hard water-softening agent (e.g., polyphosphoric acids, aminopolycarboxylic acids, phosphonic acids, and aminophosphoric acids) can be added.

The pH of the developer thus prepared is determined so as to provide the desired density and contrast, within the range of about from 8.5 to 11.5

To perform the sensitization using the first developer, the processing time is lengthened to at most about 3 times the standard processing time. In this case, if the processing temperature is increased, the time to be lengthened for the sensitization can be shortened.

For the fogging bath as used herein, known fogging agents can be used. That is, stannous ion complex salts such as stannous ion-organophosphoric acid complex salts (U.S. Pat. No. 3,617,282), stannous ion-organic phosphonocarboxylic acid complex salts (U.S. Pat. No. 4,162,161), and stannous ion-aminopolycarboxylic acid complex salts (British Pat. No. 1,209,050), boron compounds such as hydrogenated boron compounds (U.S. Pat. No. 2,984,567), and heterocyclic aminoboran compounds (British Pat. No. 1,011,000), and the like can be used. The pH of the fogging bath (reversal bath) may be varied over a wide range from the acid side to the alkaline side. The pH value is from 2 to 12, preferably from 2.5 to 10 and particularly preferably from 3 to 9.

The color developer that is used in the present invention is a color developer of the general composition containing an aromatic primary amine developing agent. Preferred examples of the aromatic primary amine color developing agent are p-phenylenediamine derivatives as shown below.

N,N-Diethyl-p-phenylenediamine, 2-amino-5-diethylaminotoluene, 2-amino-5-(N-ethyl-N-laurylamino)-toluene, 4-[N-ethyl-N-(β-hydroxyethyl)amino]aniline, 2-methyl-4-[N-ethyl-N-(β-hydroxyethyl)amino]aniline, N-ethyl-N-(β-methanesulfoamidoethyl)-3-methyl-4-amino-aniline, N-(2-amino-5-diethylaminophenylethyl)-methanesulfonamide, N,N-dimethyl-p-phenylenediamine, and 4-amino-3-methyl-N-ethyl-N-methoxyethylaniline, 4-amino-3-methyl-N-ethyl-N-β-ethoxyethylaniline and 4-amino-3-methyl-N-ethyl-N-β-butyoxyethylaniline and their salts (e.g., sulfates, chlorates, sulfites and p-toluenesulfonates) as described in U.S. Pat. Nos. 3,656,950 and 3,698,525.

The color developer can contain other known additives which are added to the developer. For example, as the alkali agent and the buffer, caustic soda, caustic potash, sodium carbonate, sodium or potassium phosphate, potassium metaborate, borax and the like can be used alone or in combination with each other.

To the color developer, sulfites (e.g., sodium sulfite, potassium sulfite, potassium hydrosulfite, and sodium hydrosulfite) and hydroxylamine, which are known as the preservatives, can be added.

If desired, a suitable development accelerator can be added to the color developer. For example, various pyridinium compounds and other cationic compounds, cationic dyes such as phenosafranine and neutral salts such as thallium nitrate as described in U.S. Pat. Nos. 2,648,604, 3,671,247 and 3,520,689, polyethylene glycol and its derivatives, and nonionic compounds such as polythioethers as described in U.S. Pat. Nos. 3,495,981, 2,533,990, 2,531,832, 2,950,970, and 2,577,127, organic solvents as described in Japanese Patent Publication No. 9509/69 and Belgian Pat. No. 682,862, and organic amines, ethanolamine, ethylenediamine, diethanolamine, etc. can be used. In addition, accelerators as described in L. F. A. Mason, *Photographic Processing Chemistry*, Focal Press, London, pp. 40–43, (1966) can be used.

In addition, hard water-softening agents, e.g., aminopolycarboxylic acids such as ethylenediamine tetraacetate, nitrilotriacetic acid, cyclohexanediamine tetraacetate, iminodiacetic acid, N-hydroxymethylethylenediamine triacetate, diethylenetriamine pentaacetate and triethylenetetraamine hexaacetate, 1-hydroxyethylidene-1,1'-diphosphoric acid, organic phosphonic acid and aminophosphoric acids such as aminotris(methylenephosphoric acid) and ethylenediamine-N,N,N',N'-tetramethylenephosphoric acid, and phosphonocarboxylic acids as described in Japanese Patent Application (OPI) Nos. 102726/77, 42730/78, 121127/79, 4024/80, 4025/80, 126241/80, 65955/80, and 65956/80, and *Research Disclosure*, Vol 181, pages 220–221, RD-18170 (May, 1979) can be added.

A competitive coupler and a compensating developer can also be added to the color developer of the present invention.

The competitive coupler includes citrazinic acid, J acid (2-amino-5-naphthol-7-sulfonic acid), and H acid (1-amino-8-naphthol-3,6-disulfonic acid).

As the compensating developer, p-aminophenol, N-benzyl-p-aminophenol or 1-phenyl-3-pyrazolidones except for the compounds of the present invention, such as 1-phenyl-3-pyrazolidone, 4-methyl-1-phenyl-3-pyrazolidone, and 4,4'-dimethyl-1-phenyl-3-pyrazolidone can be used in combination.

The pH of the color developer is preferably in the range of about from 8 to 13. The temperature of the color developer is chosen within the range of from 20° to 70° C., and preferably from 30° to 60° C.

After color development, the photographic emulsion layer is usually bleached. This bleaching may be carried out simultaneously with fixing, or the bleaching and fixing may be carried out independently. As the bleaching agent, polyvalent (e.g., iron(III), cobalt(IV), chromium(VI), and copper(II)) compounds, peracids, quinones, nitron compounds, and the like can be used. For example, ferricyanides, perchromic acids, organic complex salts of iron(III) or cobalt(III), complex salts of aminopolycarboxylic acids such as ethylenediamine tetraacetate, diethylenetriamine pentaacetate, 1,2-cyclohexanediamine tetraacetate, nitrilotriacetic acid, and 1,3-diamino-2-propanoltetraacetic acid, or organic acids such as citric acid, tartaric acid, and malic acid, persulfates, permanganates, nitrosophenol, and the like can be used. Of these compounds, potassium ferricyanide, iron(III) sodium ethylenediaminetetraacetate, and iron(III) ammonium ethylenediaminetetraccetate are particularly useful. Aminopolycarboxylic acid iron(III) complex salts are useful both in an independent bleaching solution or in a monobath bleach-fixing solution.

To the bleach or bleach-fixing solution, or its prebath (e.g., an adjusting solution), various additives such as bleach accelerators as described in U.S. Pat. Nos. 3,042,520 and 3,241,966, Japanese Patent Publication Nos. 8506/70 and 8836/70, and Japanese Patent Application (OPI) No. 95630/78 can be added.

In the fixing bath which is used in the present invention, as the fixing agent, the ammonium, sodium or potassium salt of thiosulfuric acid is used in an amount of about from 30 to 200 g/l. In addition, a stabilizer, e.g., sulfites and meta-bisulfites, a hardening agent, e.g., potash alum, and a pH buffer, e.g., acetates, borates, phosphates and carbonates can be added. The pH value of the fixing agent is from 3 to 10 and preferably from 5 to 9.

The process of processing of the present invention can be applied not only to a color photographic method using a light-sensitive material containing a dye-forming coupler, such as the methods described in U.S. Pat. Nos. 2,322,027, 2,376,679, and 2,801,171, but also to a color photographic method utilizing a developer containing therein a color-forming agent such as the methods described in U.S. Pat. Nos. 2,252,718, 2,590,970, and 2,592,243.

At present, the former method if mainly employed. In this case, the light-sensitive material to which the dye-forming coupler is added is generally a multi-layer light-sensitive material. For this reason, it is desirable that the dye-forming coupler should remain in a certain layer and not diffuse into another layer during the process of preparation, storage, and processing of the light-sensitive material.

In the light-sensitive silver halide emulsion that is used in the present invention, any of silver bromide, silver iodide, silver iodobromide, silver chlorobromide, silver chloroiodobromide, and silver chloride which are capable of forming a latent image upon imagewise exposure can be used. These silver halides may not contain a fogged nucleus in the inside thereof.

The average particle size of silver halide particles in the photographic emulsion is not critical, and preferably 3 μm or less. The average particle size is determined based on a projected area and expressed in terms of an average value with a particle diameter as the particle size in the case of spherical or nearly spherical particles, and with an edge length as the particle size in the case of cubic particles. The particle size distribution is may be narrow or broad.

The crystal form of silver halide particle may be regulalr, e.g., cubic and octahedral, or irregular, e.g., spherical and tabular, or in a composite form thereof. In addition, silver halide particles having different crystal forms may be used as a mixture.

The photographic emulsion may be a mixture of an emulsion not having a fogged nucleus in the inside of particle and an emulsion having a fogged nucleus in the inside of particle. A method of preparation of the emulsion not having a fogged nucleus in the inside of particle and the mixing ratio are described, for example, in Japanese Patent Application (OPI) No. 214855/84 or EP 127081$A_2$.

Such photographic emulsions can be prepared by the methods described, for example, in P. Glafkides, *Chimie et Physique Photographique,* Paul Montel (1967), G. F. Duffin, *Photographic Emulsion Chemistry,* The Focal Press (1966), and V. L. Zelikman et al, *Making and Coating Photographic Emulsion,* The Focal Press (1964).

In the course of formation and physical ripening of silver halide particles, cadmium salts, zinc salts, lead salts, thallium salts, iridium salts and complex salts thereof, rhodium salts and complex salts thereof, iron salts and complex salts thereof, and the like may be present.

The silver halide emulsion can be used without application of chemical sensitization, that is, as a so-called primitive emulsion. Usually, however, the silver halide emulsion is subjected to chemical sensitization. For this chemical sensitization, the methods described, for example, in the above-cited references by P. Glafkides and V. L. Zelikman et al., and H. Frieser ed., *Die Grundlagen der Photographischen Prozesse mit Silberhalogeniden,* Akademische Verlahsgesellschaft (1968) can be employed. That is, the sulfur sensitization method using a compound containing sulfur capable of reacting with silver ion, and active gelatin, the reduction sensitization method using a reducing substance, the noble metal sensitization method using a noble metal (e.g., gold) compound, and so forth can be used alone or in combination with each other.

Sulfur sensitizing agents which can be used include thiosulfates, thioureas, thiazoles, and rhodanines. Reduction sensitizing agents which can be used include stannous salts, amines, hydrazine derivatives, formamidinesulfinic acid, and silane compounds. For noble metal sensitization, gold complex salts and Group VIII metal (e.g., platinum, iridium, and palladium) complex salts can be used.

Each light-sensitive photographic emulsion layer of the light-sensitive material of the present invention contains a color-forming coupler, that is, a compound capable of forming color upon oxidative coupling with an aromatic primary amine developing agent (e.g., phenylenediamine derivatives and aminophenol derivatives) at the process of color development. For example, as the magenta coupler to be used in a green-sensitive emulsion layer, a 5-pyrazolone coupler, a pyrazolonebenzimidazole coupler, a cyanoacetylcumarone coupler, an open-chain acylacetonitrile coupler, and the like can be used. The yellow coupler which is used in the a blue-sensitive emulsion layer includes an acylacetoamide coupler (e.g., benzoylacetoanilides and pivaloylacetoanilides). The cyan coupler which is used in a red-sensitive emulsion layer includes a naphthol coupler and a phenol coupler. It is desirable for these couplers to be non-diffusing, that is, having a hydrophobic group called a ballast group in the molecule thereof. The coupler may be 4-equivalent or 2-equivalent relative to silver ion.

The photographic emulsion of the present invention may be subjected to spectral sensitization using, for example, methine dyes. Dyes which are used include a cyanine dye, a merocyanine dye, a composite cyanine dye, a composite merocyanine dye, a holopolar cyanine dye, a hemicyanine dye, a styryl dye, and a hemioxonol dye. Particularly useful dyes are those belonging to the groups of the cyanine, merocyanine and composite merocyanine dyes. In these dyes, any of nuclei which are commonly used in cyanine dyes as basic heterocyclic nuclei can be applied. That is, a pyrroline nucleus, an oxazoline nucleus, a thiazoline nucleus, a pyrrole nucleus, an oxazole nucleus, a thiazole nucleus, selenazole nucleus, an imidazole nucleus, a tetrazole nucleus, a pyridine nucleus, and the like; nuclei resulting from fusion of alicyclic hydrocarbon rings to the above nuclei; and nuclei resulting from fusion of aromatic hydrocarbon rings to these nuclei, that is, an indolenine nucleus, a benzindolenine nucleus, an indole nucleus, a benzoxazole nucleus, a naphthooxazole nucleus, a benzothiazole nucleus, a naphthothiazole nucleus, a benzoselenazole nucleus, a benzimidazole nucleus, a quinoline nucleus and the like can be applied. These nuclei may be substituted in their carbon atoms.

In the merocyanine or composite merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, and a thiobarbituric acid nucleus can be applied.

Of these sensitizing dyes, those having at least two water-soluble groups are particularly useful. These dyes are described in Japanese Patent Application (OPI) No. 135462/84.

These sensitizing dyes may be used alone or in combination with each other. Such combinations of sensitizing dyes are often used particularly for the purpose of supersensitization.

In combination with a sensitizing dye, a dye not having a spectral sensitization action by itself or a substance not substantially absorbing visible light and showing supersensitization may be added to the emulsion.

Each light-sensitive emulsion layer may comprise two or more layers, that is, be separated into two or more layers. In this case, it is preferred that a layer having higher sensitivity be provided on the top of a layer having the same color sensitivity as the above layer but having lower sensitivity.

As a binder used in each light-sensitive photographic emulsion layer, an interlayer and other layers of the present invention, it is advantageous to use gelatin. In addition, other hydrophilic colloids (e.g., gelatin derivatives) can also be used.

As the gelatin, as well as lime-processed gelatin, acid-processed gelatin, and enzyme-processed gelatin as described in *Bull. Soc. Sci. Phot. Japan,* No. 16, page 30 (1966) may be used.

To the light-sensitive material of the present invention may be added polyalkylene oxide or its ether, ester, amine or like derivatives, thioether compounds, thiomorpholine compounds, quaternary ammonium salt compounds, urethane derivatives, urea derivatives, imidazole derivatives, 3-pyrazolidone compounds, and the like for the purpose of increasing sensitivity or contrast, or of accelerating development.

The light-sensitive material of the present invention can contain various compounds as antifoggants or stabilizers. That is, a number of compounds known as antifoggants or stabilizers, such as azoles, e.g., benzothiazolium salts, nitroindazoles, triazoles, benzotriazoles, and benzoimidazoles (particularly nitro- or halogen-substituted benzoimidazoles); heterocyclic mercapto compounds, e.g., mercaptothiazoles, mercaptobenzothiazoles, mercaptobenzimidazoles, mercaptothiodiazoles, mercaptotetrazoles (particularly 1-phenyl-5-mercaptotetrazole), and mercaptopyridines; the above heterocyclic mercapto compounds further containing a carboxyl group or a sulfone group, for example; thioketo compounds, e.g., oxazolinethione; azaindenes, e.g., tetraazaindenes (particularly 4-hydroxy-substituted (1,3,3a,7) tetraazaindenes); benzenethiosulfonic acids; and benzenesulfinic acid can be contained.

The light-sensitive material of the present invention may contain an inorganic or organic hardening agent in its photographic emulsion layer and other layers. For example, chromium salts (e.g., chromium alum and chromium acetate), aldehydes (e.g., formaldehyde, glyoxal, and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloylhexahydro-S-triazine and 1,3-vinylsulfonyl-2-propanol), active halogen compounds (e.g., 2,4-dichloro-6-hydroxy-S-triazine) and mucohalogenic acids (e.g., mucochloric acid and mucophenoxychloric acid) can be used alone or in combination with each other.

The light-sensitive material of the present invention may contain a developing agent. Developing agents as described in *Research Disclosure,* Vol. 176, page 29, RD-17643 (December, 1978), "Developing Agents" can be used.

The light-sensitive material of the present invention may contain dyes as filter dyes or for other various purposes such as prevention of irradiation in the photographic layer and other layers thereof. For example, dyes as described in *Research Disclosure,* Vol. 176 p.p. 25–26, RD-17643 (December, 1978) "Absorbing and Filter Dyes" can be used.

The light-sensitive material of the present invention may contain various additives such as an antistatic agent, a plasticizer, a matting agent, a lubricating agent, an ultraviolet ray-absorbing agent, a brightening agent, and an air antifoggant.

The silver halide emulsion layer and/or other layers are coated on a support. This coating can be carried out by the methods described in *Research Disclosure,* Vol. 176, p.p. 27–28, RD-17643 (December, 1978) "Coating Procedure".

The present invention is described below in greater detail with reference to the following examples.

EXAMPLE 1

The following first to twelfth layers were coated on a traiacetate film support in the order listed, to prepare a color reversal photographic light-sensitive material.

First Layer: Antihalation Layer (gelatin layer containing black colloid silver)

Second Layer: Gelatin Interlayer 2,5-Di-tert-octylhydroquinone was dissolved in a mixture of 100 ml of dibutyl phthalate and 100 ml of ethyl acetate, and then mixed with 1 kg of a 10 wt% aqueous gelatin solution. The resulting mixture was stirred at high speed to prepare an emulsion. Then, 2 kg of the emulsion thus-prepared was mixed with 1 kg of a fine particle emulsion (particle size: 0.06 μm; 1 mol% silver iodobromide emulsion) which had not been chemically sensitized and further with 1.5 kg of 10 wt% gelatin. The resulting mixture was coated in a dry film thickness of 2 μm (amount of silver: 0.4 g/m$^2$).

Third Layer: Slow-speed Red-Sensitive Emulsion Layer 100 g of 2-(heptafluorobutylamido)-5[2'-(2'',4''-di-tert-aminophenoxy)butylamido]-phenol as a cyan coupler was dissolved in a mixture of 100 ml of tricresyl phosphate and 100 ml of ethyl acetate, and then mixed with 1 kg of a 10 wt% aqueous gelatin solution. The resulting mixture was stirred at high speed to prepare an emulsion. Then, 500 g of the emulsion thus-prepared was mixed with 1 kg of a red-sensitive silver iodobromide emulsion (containing 70 g of silver and 60 g of gelatin; iodine content: 6 mol%). The resulting mixture was coated in a dry film thickness of 1 μm (amount of silver: 0.5 g/m$^2$).

Fourth Layer: High-speed Red-Sensitive Emulsion Layer 100 g of 2-(heptafluorobutylamido)-5-[2'-(2'',4''-di-tert-aminophenoxy)butylamido]-phenol as a cyan coupler was dissolved in a mixture of 100 ml of tricresyl phosphate and 100 ml of ethyl acetate and then mixed with 1 kg of a 10 wt% aqueous gelatin solution. The resulting mixture was stirred at high speed to prepare an emulsion. Then, 1,000 g of the emulsion thus-prepared was mixed with 1 kg of a red-sensitive silver iodobromide emulsion (containing 70 g of silver and 60 g of gelatin; iodine content: 6 mol%). The resulting mixture was coated in a dry film thickness of 2.5 μm (amount of silver: 0.8 g/m²).

Fifth Layer: Interlayer 2,5-Di-tert-octylhydroquinone was dissolved in a mixture of 100 ml of dibutyl phthalate and 100 ml of ethyl acetate and then mixed with 1 kg of a 10 wt% aqueous gelatin solution. The resulting mixture was stirred at high speed to prepare an emulsion. Then, 1 kg of the emulsion thus-prepared was mixed with 1 kg of 10 wt% gelatin. The resulting mixture was coated in a dry film thickness of 1 μm.

Sixth Layer: Slow-speed Green-Sensitive Emulsion Layer

An emulsion was prepared in the same manner as in preparation of the emulsion used in the first layer except that 1-(2,4,6-trichlorophenyl)-3-[3-(2,4-di-tert-amylphenoxyacetamido)benzamido]-5-pyrazolone as a magenta coupler was used in place of the cyan coupler. 300 g of the emulsion thus-prepared was mixed with 1 kg of a green-sensitive silver iodobromide emulsion (containing 70 g of silver and 60 g of gelatin; iodine content: 7 mol%). The resulting mixture was coated in a dry film thickness of 1.3 μm (amount of silver: 1.1 g/m²).

Seventh Layer: High-speed Green-Sensitive Emulsion Layer

An emulsion was prepared in the same manner as in preparation of the emulsion used in the first layer except that 1-(2,4,6-trichlorophenyl)-3-[3-(2,4-di-tert-amylphenoxyacetamido)benzamido]-5-pyrazolone as a magenta coupler was used in place of the cyan coupler. 1,000 g of the emulsion thus-prepared was mixed with 1 kg of a green-sensitive silver iodobromide emulsion (containing 70 g of silver and 60 g of gelatin; iodine content: 6 mol%). The resulting mixture was coated in a dry film thickness of 3.5 μm (amount of silver: 1.1 g/m²).

Eighth Layer: Yellow Filter Layer

An emulsion containing yellow colloid silver was coated in a dry film thickness of 1 μm.

Ninth Layer: Slow-speed Blue-Sensitive Emulsion Layer

An emulsion was prepared in the same manner as in preparation of the emulsion used in the first layer except that α-(pivaloyl)-α-(1-benzyl-5-ethoxy-3-hydantoinyl)-2-chloro-5-dodecyloxycarbonylacetanilide as a yellow coupler was used in place of the cyan coupler. 1,000 g of the emulsion thus-prepared was mixed with 1 kg of a blue-sensitive silver iodobromide emulsion (containing 70 g of silver and 60 g of gelatin; iodine content: 7 mol%). The resulting mixture was coated in a dry film thickness of 1.5 μm (amount of silver: 0.4 g/m²).

Tenth Layer: High-speed Blue-Sensitive Emulsion Layer

An emulsion was prepared in the same manner as in preparation of the emulsion used in the first layer except that α-(pivaloyl)-α-(1-benzyl-5-ethoxy-3-hydantoinyl)-2-chloro-5-dodecyloxycarbonylacetoanilide as a yellow coupler was used in place of the cyan coupler. 1,000 g of the emulsion thus-prepared was mixed with 1 kg of a blue-sensitive silver iodobromide emulsion (containing 70 g of silver and 60 g of gelatin; iodine content: 6 mol%). The resulting mixture was coated in a dry film thickness of 3 μm (amount of silver: 0.8 g/m²).

Eleventh Layer: Second Protective Layer 1 kg of the same emulsion as used in the second layer was mixed with 1 kg of 10 wt% gelatin. The resulting mixture was coated in a dry film thickness of 2 μm.

Twelfth Layer: First Protective Layer

A 10 wt% aqueous gelatin solution containing an emulsion of surface-fogged fine particles (particle size: 0.06 μm; 1 mol% silver iodobromide emulsion) was coated in such a manner that the amount of silver coated was 0.1 g/m² and the dry film thickness was 0.8 μm.

The above-prepared light-sensitive material sample was exposed through a wedge for sensitometry to white light at an illumination on the exposed area of 1,000 lux, and then was subjected to reversal sensitization processing to obtain a color image.

The processing steps and processing solutions used at the steps were as follows.

Sensitization Processing Steps:

| | Time (min) | Temperature (°C.) |
|---|---|---|
| First development | 10 | 38 |
| Rinsing with water | 2 | " |
| Reversal | 2 | " |
| Color development | 6 | " |
| Adjustment | 2 | " |
| Bleaching | 6 | " |
| Fixing | 4 | " |
| Rinsing with water | 4 | " |
| Stabilization | 1 | Ordinary temperature |
| Drying | — | 80 or less |

The processing solutions are shown below.

To the black-and-white developer were added compounds of Groups A and B, or comparative compounds as shown in Table 1. Further the black-and-white developer was applied as such in Sample No. 19. In Sample Nos. 11 to 18, compounds of Groups A, B, and C as shown in Table 2 were added to the black-and-white developer.

Black-and-White Developer

Water: 700 ml,
Nitrilo-N,N,N-trimethylenephosphoric acid pentasodium salt: 2 g,
Sodium sulfite: 20 g,
Hydroquinone monosulfonate potassium salt: 30 g,
Sodium carbonate (monohydrate): 30 g,
1-Phenyl.4-methyl.4-hydroxymethyl-3-pyrazolidone: 2 g,
Potassium bromide: 2.5 g,
Potassium thiocyanate: 1.2 g,
Potassium bromide (0.1 wt% solution): 2 ml,
Water to make: 1,000 ml.
(pH=10.1)

Reversal Solution

Water: 700 ml,
Nitrilo-N,N,N-trimethylenephosphoric acid hexasodium salt: 3 g,
Stannous chloride (dihydrate): 1 g,
p-Aminophenol: 0.1 g,
Sodium hydroxide: 8 g,
Glacial acetic acid: 15 ml, Water to make: 1,000 ml.

Color Developer

Water: 700 ml,
Nitrilo-N,N,N-trimethylenephosphoric acid hexasodium salt: 2 g,
Sodium sulfite: 7 g,
Sodium tertiary phosphate (12 hydrate): 36 g,
Potassium bromide: 1 g,
Potassium iodide (0.1 wt% solution): 90 ml,
Sodium hydroxide: 3 g,
Citrazinic acid: 1.5 g,
N-Ethyl-N-(β-methanesulfonamidoethyl)-3-methyl-4-aminoaniline sulfonate: 11 g,
3,6-Dithiooctan-1,8-diol: 1 g,
Water to make: 1,000 ml.

Adjusting Solution

Water: 700 ml,
Sodium sulfite: 12 g,
Sodium ethylenediaminetetraacetate (dihydrate): 8 g,
Thioglycerine: 0.4 ml,
Glacial acetic acid: 3 ml,
Water to make: 1,000 ml.

Bleaching Solution

Water: 800 ml,
Sodium ethylenediaminetetraacetate (dihydrate): 2.0 g,
Iron(III) ammonium ethylenediamine-tetraacetate (dihydrate): 120.0 g,
Potassium bromide: 100.0 g,
Water to make: 1,000 ml.

Fixing Solution

Water: 800 ml,
Ammonium thiosulfate: 80.0 g,
Sodium sulfite: 5.0 g,
Sodium hydrogensulfite: 5.0 g,
Water to make: 1,000 ml.

Stabilizing Solution

Water: 800 ml,
Formalin (37 wt%): 5.0 ml,
Fuji Drywell (produced by Fuji Photo Film Co., Ltd.): 5.0 ml,
Water to make: 1,000 ml.

TABLE 1

| Sample No. | | Added Compound Group A | Group B | Yellow Δ Dmax | Δ C.B. | Magenta Δ Dmax | Cyan Δ Dmax | Δ C.B. |
|---|---|---|---|---|---|---|---|---|
| 1 | Example of the present invention | A-2 | B-2 | 0.15 | 0.00 | 0.10 | 0.10 | 0.00 |
| 2 | Example of the present invention | A-2 | B-10 | 0.08 | 0.00 | 0.10 | 0.05 | 0.00 |
| 3 | Example of the present invention | A-2 | B-11 | 0.10 | 0.00 | 0.10 | 0.10 | 0.00 |
| 4 | Example of the present invention | A-10 | B-2 | 0.10 | 0.00 | 0.10 | 0.05 | 0.00 |
| 5 | Example of the present invention | A-10 | B-10 | 0.10 | 0.00 | 0.05 | 0.05 | 0.00 |
| 6 | Example of the present invention | A-94 | B-2 | 0.20 | 0.05 | 0.00 | 0.05 | −0.05 |
| 7 | Example of the present invention | A-94 | B-10 | 0.25 | 0.05 | 0.00 | 0.05 | −0.05 |
| 8 | Comparative Example | A-2 | — | 0.10 | 0.20 | 0.05 | 0.00 | 0.00 |
| 9 | " | A-10 | — | 0.20 | 0.35 | −0.10 | 0.00 | 0.00 |
| 10 | " | — | B-2 | 0.00 | 0.00 | 0.05 | 0.05 | 0.15 |

TABLE 2

| Sample No. | | Added Compound Group A | Group B | Group C | Yellow Dmax | Δ C.B. | Magenta Dmax | Cyan Dmax | Δ C.B. |
|---|---|---|---|---|---|---|---|---|---|
| 11 | Example of the present invention | A-2 | B-2 | C-5 | 2.60 | 0.04 | 2.55 | 2.40 | 0.01 |
| 12 | Example of the present invention | A-2 | B-2 | C-3 | 2.65 | 0.02 | 2.52 | 2.45 | 0.00 |
| 13 | Example of the present invention | A-2 | B-2 | C-13 | 2.55 | 0.01 | 2.54 | 2.50 | 0.02 |
| 14 | Example of the present invention | A-28 | B-11 | C-5 | 2.65 | 0.01 | 2.60 | 2.41 | 0.00 |
| 15 | Example of the present invention | A-40 | B-10 | C-5 | 2.48 | −0.01 | 2.55 | 2.45 | 0.01 |
| 16 | Example of the present invention | A-2 | B-10 | C-5 | 2.55 | 0.01 | 2.60 | 2.41 | −0.02 |
| 17 | Example of the present invention | A-2 | B-10 | C-3 | 2.58 | 0.02 | 2.60 | 2.50 | 0.03 |
| 18 | Example of the present invention | A-2 | B-10 | C-13 | 2.50 | 0.00 | 2.58 | 2.45 | 0.00 |
| 19 | Comparative Example | — | — | — | 2.30 | 0 (base) | 2.40 | 2.16 | 0 (base) |

In Table 1, the amount of the compound of Group A added was $4.5\times10^{-6}$ mol per liter of the black-and-white developer, and the amount of the compound of Group B added was $7.5\times10^{-5}$ mol.

In Table 2, the amount of the compound of Group A added was $1\times10^{-5}$ mol per liter of the standard black-and-white developer; the amount of the compound of Group B added was $5.0\times10^{-5}$ mol; and the amount of the compound of Group C added was $1.0\times10^{-5}$ mol.

The characteristic values, ΔDmax and ΔC.B., in Table 1 and 2 are defined, for each of the yellow, magenta and cyan images, as follows.

ΔDmax=(Dmax at Processing II)−(Dmax at Processing I)

ΔC.B.=(C.B. at Processing II)−(C.B. at Processing I)

Dmax indicates a maximum density at the reversal processing. The maximum density is for unexposed areas and corresponds to an amount of silver halide not developed by the black-and-white development. If fog is prevented by the black-and-white development, the maximum density is positive. C.B. indicates the color balance after the reversal processing. This is defined by the following formulae with the density of each of yellow and cyan images when such an exposure amount that the density of the magenta image is 1.00 is given, as $D_B$ and $D_R$, respectively.

C.B. (yellow)$=D_B-1.00$

C.B. (cyan)$=D_R-1.00$

For example, when the color balance deviated to the yellow side as compared with Processing I, ΔC.B. of yellow takes a positive value. On the contrary, when the color balance deviated to the blue side, ΔC.B. of yellow takes a negative value. In a reversal film for cameras, to obtain an image satisfactory in the color balance, it is preferred for the ΔC.B. value to be 0. Even at the processing I as a sensitization processing, a preferred color balance was obtained as in the standard processing (development for 6 minutes).

Processing I indicates a process in which push development is carried for 10 minutes using a black-and-white developer and thereafter a reversal processing is applied. Processing II indicates a process in which development is carried out using a black-and-white developer with each of the compounds of Table 1 added thereto, to an extent that the sensitivity is equal to that of the magenta image obtained by Processing I and, thereafter, a reversal processing is carried out.

The results of Table 1 demonstrate that when the compounds of Group A only are added (Nos. 8 and 9), ΔC.B. of yellow takes a positive value, and there can be obtained only an image in which the color balance is seriously deviated to the yellow side as compared with Processing I. Moreover it is demonstrated that when only the compounds of Group B are added (No. 10), ΔC.B. of cyan takes a positive value, and there can be obtained only an image in which the color balance is deviated to the cyan side as compared with Processing I. Therefore it would be naturally expected that if the compounds of Groups A and B were used in combination, ΔC.B. of yellow and cyan both take positive values and there can be obtained only an image in which the color balance is deviated to the cyan and yellow sides. In practice, however, when the compounds are added in combination, ΔC.B. values of cyan and yellow are zero or small. This indicates that there is almost no deviation in the color balance. Moreover it can be seen that Dmax is a positive value, an image of high maximum density as compared with Processing I is obtained, and fog at the black-and-white development is prevented.

On the other hand, as is apparent from the results of Table 2, when a black-and-white developer containing the compounds of Groups A, B, and C is used (Sample Nos. 11 to 18), the yellow, magenta, and cyan images are uniform in the maximum density, and all the maximum density values are higher than that of Sample No. 19. Also, the ΔC.B. value is almost equal to that of Sample No. 19.

Furthermore, in practical application, the black-and-white developer of the present invention provides an image in which the black areas are of high quality.

As described above, it is shown that even if the sensitization processing is carried out prolonging the developing time in the method of processing of the present invention, there can be obtained a reversal color photographic image in which the deviation in the color balance is small.

EXAMPLE 2

Color reversal processing was carried out in the same manner as in Example 1, except that compounds of Groups A and B, or compounds of Groups A, B, and C as shown in Tables 3 and 4, and further, as a development accelerator, a compound having the formula:

$$HO—CH_2CH_2—S—CH_2CH_2—S—CH_2CH_2OH$$

were added in an amount of 0.20 per 1 liter of the developer, and the developing time was changed to 9 minutes.

TABLE 3

| Sample No | | Added Compound Group A | Group B | Yellow Δ Dmax | Δ C.B. | Magenta Δ Dmax | Cyan Δ Dmax | Δ C.B. |
|---|---|---|---|---|---|---|---|---|
| 20 | Example of the present invention | A-2 | B-10 | 0.50 | 0.00 | 0.45 | 0.25 | 0.05 |
| 21 | Example of the present invention | A-2 | B-2 | 0.56 | 0.05 | 0.45 | 0.20 | 0.05 |
| 22 | Example of the present invention | A-2 | B-5 | 0.15 | 0.00 | 0.15 | 0.05 | 0.00 |
| 23 | Example of the present invention | A-10 | B-2 | 0.17 | 0.00 | 0.30 | 0.10 | 0.05 |
| 24 | Example of the present invention | A-94 | B-5 | 0.25 | 0.05 | 0.15 | 0.15 | 0.00 |
| 25 | Example of the present invention | A-28 | B-10 | 0.50 | 0.05 | 0.50 | 0.10 | 0.00 |
| 26 | Example of the present invention | A-91 | B-10 | 0.50 | 0.05 | 0.40 | 0.35 | 0.00 |

Development Accelerator:
$HO—CH_2CH_2—S—CH_2CH_2—S—CH_2—CH_2—OH$

TABLE 4

| Sample No. | | Added Compound Group A | Group B | Group C | Yellow Dmax | Δ C.B. | Magenta Δ Dmax | Cyan Dmax | Δ C.B. |
|---|---|---|---|---|---|---|---|---|---|
| 27 | Example of the present invention | A-2 | B-5 | C-2 | 2.55 | −0.02 | 2.68 | 2.53 | −0.03 |
| 28 | Example of the present invention | A-2 | B-5 | C-8 | 2.69 | 0.01 | 2.62 | 2.54 | −0.03 |
| 29 | Example of the present invention | A-2 | B-5 | C-12 | 2.57 | −0.03 | 2.67 | 2.50 | 0.00 |

TABLE 4-continued

| Sample No. | | Added Compound Group A | Group B | Group C | Yellow Dmax | Δ C.B. | Magenta Δ Dmax | Cyan Dmax | Δ C.B. |
|---|---|---|---|---|---|---|---|---|---|
| 30 | Example of the present invention | A-2 | B-5 | C-19 | 2.65 | 0.02 | 2.70 | 2.51 | 0.01 |
| 31 | Example of the present invention | A-2 | B-3 | C-2 | 2.59 | 0.00 | 2.59 | 2.50 | 0.00 |
| 32 | Example of the present invention | A-28 | B-5 | C-2 | 2.62 | 0.01 | 2.62 | 2.49 | 0.02 |
| 33 | Comparative Example* | — | — | — | 2.30 | −0.25 | 2.40 | 2.16 | 0.35 |

Note:
*No development accelerator is added.

As shown in Table 3, even when a development accelerator is added to a black-and-white developer with the compounds of Groups A and B added thereto, an image in which the absolute value of ΔC.B. is small and Dmax is high as in Example 1 can be obtained. Accordingly, it can be seen that the method of the present invention provides a reversal color photographic image in which the maximum density is high and the deviation in the color balance is small as compared with the case where the sensitization processing is carried out for longer time (from 6 minutes to 9 minutes).

It can be seen from the results of Table 4 that even when a black-and-white developer with a development accelerator added thereto is used, if compounds of Groups A, B, and C are added to the developer, there can be obtained an image in which the maximum density of each of yellow, magenta, and cyan is high and the maximum densities thereof are uniform, and in which the color balance is satisfactory.

The process of the present invention provides many advantages which could not be attained by conventional processes.

One of the advantages is that when processing is carried out under such conditions intended to obtain high sensitivity, there can be obtained an image in which the maximum density is high and the color balance is good over all density ranges. In accordance with conventional methods, if the temperature for black-and-white development is increased, the developing time is lengthened, or development is accelerated using a development accelerator in order to obtain high sensitivity, the formation of fog due to development in the lowermost (red-sensitive) layer is increased. As a result, the maximum density of a cyan image in the final image is decreased and the color balance is such that the image is greatly reddish, and therefore the quality of the image is seriously decreased. On the other hand, the process of the present invention eliminates the above problems.

Another advantage is that a good photographic image of different sensitivity can be obtained on the same light-sensitive material using a certain predetermined developer but by changing processing conditions. That is, by changing the temperature, time, and degree of agitation conventionally employed for black-and-white development, sensitivity can be changed with the same light-sensitive material. In accordance with the process of the present invention, development of blue-sensitive, green-sensitive, and red-sensitive layers can be carried out in a similar condition and therefore the color balance is similar at different sensitivities. Thus an image of sufficiently satisfactory quality can be obtained.

Further advantage is that even in carrying out the processing in a short time and rapidly by the conventional development-accelerating methods, an image of high maximum density and good color balance can be obtained. That is, if a black-and-white development-accelerating method is employed for the purpose of rapid processing, a sufficient development-accelerating effect cannot be obtained without causing problems of a reduction in the maximum density of a color image and unbalance in color. On the other hand, the process of the present invention permits to obtain an image of good quality without causing the above problems.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide color reversal photographic light-sensitive material, which comprises treating an imagewise exposed silver halide color reversal photographic light-sensitive material with a black-and-white developer containing at least one compound selected from the compounds of Group A and at least one compound selected from the compounds of Group B, wherein Group A consists of organic heterocyclic compounds represented by formulae (A-I), (A-II), (A-III), and (A-IV)

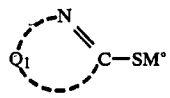
(A-I)

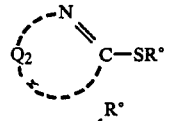
(A-II)

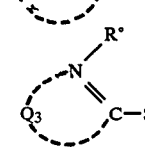
(A-III)

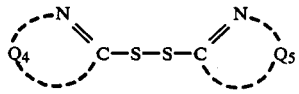
(A-IV)

wherein $Q_1$, $Q_2$, $Q_3$, $Q_4$, and $Q_5$ each represents an atomic group forming a 5- or 6-membered substituted or unsubstituted heterocyclic group, or an atomic group forming a 5- or 6-membered substituted or unsubstituted heterocyclic group condensed with a benzene ring; R° represents a substituted or unsubstituted alkyl group, a substituted or unsubstituted aryl group, or a substituted or unsubstituted aralkyl group; and M° represents a hydrogen atom, an alkali metal atom, or an ammonium ion; and Group B consists of benzimidazole, indazole, benzotriazole, benzoxazole, and benzothiazole compounds, provided that they do not contain a thiol group, a thioether bond, a thioketone group, or a disulfide bond, the color reversal photographic light-sensitive material then being subjected to a fogging treatment and color development.

2. A process as in claim 1, wherein the black-and-white developer contains at least one compound selected from the compounds of Group A aside from the compounds of formulae (C-I) and (C-II) as defined below, at least one compound selected from the compounds of Group B, and further at least one compound selected from the compounds of Group C, wherein Group C consists of compounds represented by formulae (C-I) and (C-II):

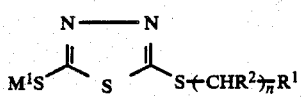

(C-I)

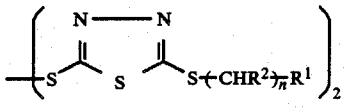

(C-II)

wherein $M^1$ represents a hydrogen atom, an alkali metal atom, or an ammonium ion; $R^1$ represents $-(\text{alkylene})_m-SO_3M^2$ or $-(\text{alkylene})_m-COOM^2$, $R^2$ represents a hydrogen atom, a substituted or unsubstituted alkyl group (the total number of carbon atoms of alkyl group is 1 to 4), $-SO_3M^2$, or $-COOM^2$; $M^2$ represents a hydrogen atom, an alkali metal atom, or an ammonium ion; Alkylene may be a substituted or unsubstituted straight-chain, or a substituted or unsubstituted branch-chain (the total number of carbon atoms of the alkylene is 1 to 4); m is 0 or 1; and n is an integer of from 1 to 6, provided that when n is 2 or more, the groups can be the same or different.

3. A process as in claim 1, wherein the amount of the compound of Group A in the black-and-white developer is from $0.5\times10^{-6}$ to $0.5\times10^{-2}$ mol per liter of the black-and-white developer, and the amount of the compound of Group B in the black-and-white developer is from $0.5\times10^{-5}$ to $1.0\times10^{-1}$ mol per liter of the black-and-white developer.

4. A process as in claim 2, wherein the amount of the compound of Group C in the black-and-white developer is from $0.5\times10^{-6}$ to $5\times10^{-2}$ mol per liter of the black-and-white developer.

5. A process as in claim 1, wherein the amount of the compound of Group A in the black-and-white developer is from $1.0\times10^{-6}$ to $0.5\times10^{-3}$ mol per liter of the black-and-white developer, and the amount of the compound of Group B in the black-and-white developer is from $1.0\times10^{-5}$ to $1.0\times10^{-2}$ mol per liter of the black-and-white developer.

6. A process as in claim 2, wherein the amount of the compound of Group C in the black-and-white developer is from $1.0\times10^{-6}$ to $1.0\times10^{-4}$ mol per liter of the black-and-white developer.

7. A process as in claim 1, wherein the molar ratio of the compound of Group B to the compound of Group A is from 2/1 to 500/1.

8. A process as in claim 2, wherein the molar ratio of the compound of Group B to the compound of Group C to the compound of Group A is 2-500/0.1-50/1.

9. A process as in claim 2, wherein the molar ratio of the compound of Group B to the compound of Group C to the compound of Group A is 2-100/0.1-20/1.

10. A process as in claim 1, wherein the heterocyclic group formed by $Q_1$, $Q_2$, $Q_3$, $Q_4$ or $Q_5$ is a pyrrole ring, a pyrazole ring, an imidazole ring, an imidazoline ring, a benzimidazole ring, a benzimidazoline ring, a triazole ring, a tetrazole ring, a thiazole ring, a thiazoline ring, a benzothiazole ring, a naphthothiazole ring, a benzothiazoline ring, an oxazole ring, an oxazoline ring, a benzoxazole ring, a benzoxazoline ring, a pyridine ring, a pyrimidine ring, a triazine ring, a pyrazine ring, a thiazine ring, an oxazine ring, a thiodiazole ring, an oxadiazole ring, or a tetraazaindene ring.

11. A process as in claim 10, which the heterocyclic group is substituted with a substituted or unsubstituted alkyl group, an allyl group, a substituted or unsubstituted aryl group, a substituted or unsubstituted aralkyl group, a halogen atom, a nitro group, a substituted or unsubstituted alkoxy group, a substituted or unsubstituted aryloxy group, a substituted or unsubstituted alkylthio group, a substituted or unsubstituted arylthio group, $-COOM^3$, $-COOR^3$, $-SO_3M^3$, $-SO_3R^3$, $-SO-R^3$, $-SO_2R^3$, $-NH_2$, $-NHR^3$,

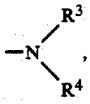

$-NHCOR^3$, $-NH.CO.NH.R^3$, $-NHCO_2R^3$, $-CONH-R^3$, $-CONH_2$, $-SO_2NH_2$, $-SO_2NHR^3$ (wherein $M^3$ is a hydrogen atom, $NH_4$, or an alkali metal, and $R^3$ and $R^4$ each is a substituted or unsubstituted alkyl group, an aryl group, an aralkyl group or heterocyclic group).

12. A process as in claim 1, wherein the black-and-white developer further contains a silver halide solvent.

13. A process as in claim 12, wherein the silver halide solvent is KSCN, NaSCN, $K_2SO_3$, $Na_2SO_3$, $K_2S_2O_5$, $Na_2S_2O_5$, $K_2S_2O_3$ or $Na_2S_2O_3$.

14. A process as in claim 1, wherein the black-and-white developer further contains at least one development accelerator represented by the general formula (D)

$$R_{12}-(S-R_{11})_d-S-R_{12},$$

wherein $R_{11}$ is an alkylene group having from 2 to 10 carbon atoms, which may contain an ether bond, $R_{12}$ is an alkyl group having from 2 to 10 carbon atoms, which can be substituted or can contain an ether bond or an ester bond, and d is an integer of from 0 to 3.

15. A process as in claim 14, wherein an amount of the development accelerator is from $5\times10^{-6}$ to $5\times10^{-1}$ mol per liter of the black-and-white developer.

16. A process as in claim 15, wherein an amount of the development accelerator is from $1\times10^{-4}$ to $2\times10^{-1}$ mol per liter of the black-and-white developer.

17. A process as in claim 14, wherein the black-and-white developer further contains a silver halide solvent.

18. A process as in claim 1, wherein the silver halide color reversal photographic light-sensitive material comprises at least one green-sensitive emulsion layer, at least one blue-sensitive emulsion layer, and at least one red-sensitive emulsion layer.

19. A process as in claim 18, wherein color development is with a color developing composition containing an aromatic primary amine developing agent.

20. A process as in claim 19, wherein the fogging treatment is with a fogging bath which has a pH of from 2 to 12.

* * * * *